US010340579B2

(12) United States Patent
Tsukada

(10) Patent No.: US 10,340,579 B2
(45) Date of Patent: Jul. 2, 2019

(54) ATTACHMENT INSTRUMENT FOR ELECTRONIC DEVICES, ANGLE ADJUSTING METHOD, AND COMMUNICATION APPARATUS

(71) Applicant: NEC Corporation, Minato-ku, Tokyo (JP)

(72) Inventor: Akira Tsukada, Tokyo (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 15/568,833

(22) PCT Filed: Jan. 6, 2016

(86) PCT No.: PCT/JP2016/000039

§ 371 (c)(1),
(2) Date: Oct. 24, 2017

(87) PCT Pub. No.: WO2016/185638

PCT Pub. Date: Nov. 24, 2016

(65) Prior Publication Data

US 2018/0115047 A1 Apr. 26, 2018

(30) Foreign Application Priority Data

May 15, 2015 (JP) ..... 2015-100152

(51) Int. Cl.
*H01Q 1/12* (2006.01)
*H01Q 3/08* (2006.01)

(52) U.S. Cl.
CPC ..... *H01Q 1/125* (2013.01); *H01Q 1/12* (2013.01); *H01Q 1/1228* (2013.01); *H01Q 3/08* (2013.01)

(58) Field of Classification Search
CPC ..... H01Q 1/12; H01Q 1/1228; H01Q 1/125; H01Q 3/08; H01Q 1/25
See application file for complete search history.

(56) References Cited

U.S. PATENT DOCUMENTS 5,941,497 A * 8/1999 Inoue ..... H01Q 1/125 248/291.1
6,762,731 B1 * 7/2004 Chou ..... H01Q 1/125 343/880
2005/0264467 A1 * 12/2005 Lin ..... H01Q 1/125 343/882
2012/0211632 A1 * 8/2012 Yang ..... H01Q 1/1207 248/397

FOREIGN PATENT DOCUMENTS

JP H04-120802 A 4/1992
JP H05-002419 U 1/1993
JP 2010-239520 A 10/2010

OTHER PUBLICATIONS

International Search Report for PCT Application No. PCT/JP2016/000039, dated Feb. 2, 2016.

* cited by examiner

*Primary Examiner* — Hoang V Nguyen

(57) ABSTRACT

An attachment instrument for an electronic device (10) includes a first angle adjustment part (30) configured to adjust an orientation of an antenna included in the electronic device (10) by two arc-shaped long holes (31*a*, 31*b*) formed in a plane and two axes (32*a*, 32*b*) moving inside the two long (31*a*, 31*b*), respectively. The first angle adjustment part (30) makes the adjustment by the axis (32*a*) inside one of the long holes (31*a*) being fixed and the axis (32*b*) inside the other one of the long holes (31*b*) being allowed to move.

17 Claims, 5 Drawing Sheets

ATTACHMENT INSTRUMENT FOR ELECTRONIC DEVICES, ANGLE ADJUSTING METHOD, AND COMMUNICATION APPARATUS

This application is a National Stage Entry of PCT/JP2016/000039 filed on Jan. 6, 2016, which claims priority from Japanese Patent Application 2015-100152 filed on May 15, 2015, the contents of all of which are incorporated herein by reference, in their entirety.

TECHNICAL FIELD

The present disclosure relates to an attachment instrument for an electronic device, an angle adjusting method, and a communication apparatus.

BACKGROUND ART

There are some electronic devices that are integrated with antennas and that include directivity. An example of such an electronic device is a communication apparatus that establishes a point-to-point connection with another apparatus to perform wireless communication. A point-to-point communication apparatus is generally attached to a support column in a high position such as a utility pole in order to avoid deterioration of communication quality due to an influence of an obstacle.

The attachment instrument for attaching the electronic device having the directivity to the support column is required to have a function capable of adjusting an azimuth angle and an elevation angle of the antenna included in the electronic device. In addition, it is said that the distance from the support column is desirably short from the viewpoint of good appearance.

Examples of the attachment instrument for antennas are disclosed in Patent Literature 1 and 2. In the attachment instrument disclosed in Patent Literature 1 and 2, a round hole and an arc-shaped long hole are formed in one plane. Further, a screw inserted into the round hole is used as a rotation axis, and a screw inserted into the arc-shaped long hole is made to function as a rotation guide. Then, the antenna is rotated in an azimuth angle direction or an elevation angle direction to adjust an azimuth angle and an elevation angle of the antenna.

CITATION LIST

Patent Literature

Patent Literature 1: Japanese Unexamined Patent Application Publication No. 04-120802

Patent Literature 2: Japanese Unexamined Utility Model Application Publication No. 05-002419

SUMMARY OF INVENTION

Technical Problem

However, in the attachment instruments disclosed in Patent Literature 1 and 2, only one set of the round hole and the arc-shaped long hole is provided, and there is only one rotation axis. Thus, an angle adjustment range of the antenna is determined by the size of the arc-shaped long hole (a length of the arc). Therefore, in order to enlarge the angle adjustment range of the antenna, it is necessary to increase the size of the arc-shaped long hole, resulting in a problem that the size of the attachment instrument is increased.

In this regard, one of objects of the present disclosure is to solve the above-described problem and to provide a technique capable of enlarging the angle adjustment range of the antenna included in the electronic device without increasing the size of the attachment instrument.

Solution to Problem

In one aspect, an attachment instrument for an electronic device includes a first angle adjustment part configured to adjust an orientation of an antenna included in the electronic device by two arc-shaped first long holes formed in a first plane and two axes moving inside the two first long holes, respectively.

The first angle adjustment part makes the adjustment by the axis inside one of the first long holes being fixed and the axis inside the other one of the first long holes being allowed to move.

In another aspect, an angle adjusting method for an electronic device includes a first angle adjustment step for adjusting an orientation of an antenna included in the electronic device by two arc-shaped first long holes formed in a first plane and two axes moving inside the two first long holes, respectively.

In the first angle adjustment step, the adjustment is made by the axis inside one of the first long holes being fixed and the axis inside the other one of the first long holes being allowed to move.

In another aspect, a communication apparatus includes: an antenna; and a first angle adjustment mechanism configured to adjust an orientation of the antenna by two arc-shaped first long holes formed in a first plane and two axes moving inside the two first long holes, respectively.

The first angle adjustment mechanism makes the adjustment by the axis inside one of the first long holes being fixed and the axis inside the other one of the first long holes being allowed to move.

Advantageous Effects of Invention

According to the above-described aspects, it is possible to achieve an effect of enlarging the angle adjustment range of the antenna included in the electronic device without increasing the size of the attachment instrument.

DESCRIPTION OF EMBODIMENTS

Hereinafter, embodiments of the present disclosure will be described with reference to the drawings. The same or corresponding elements are denoted by the same signs throughout the drawings, and repeated descriptions will be omitted as necessary.

(1) First Embodiment

An attachment instrument for an electronic device according to this embodiment has a configuration capable of adjusting an elevation angle of an antenna included in the electronic device.

Figure 1:
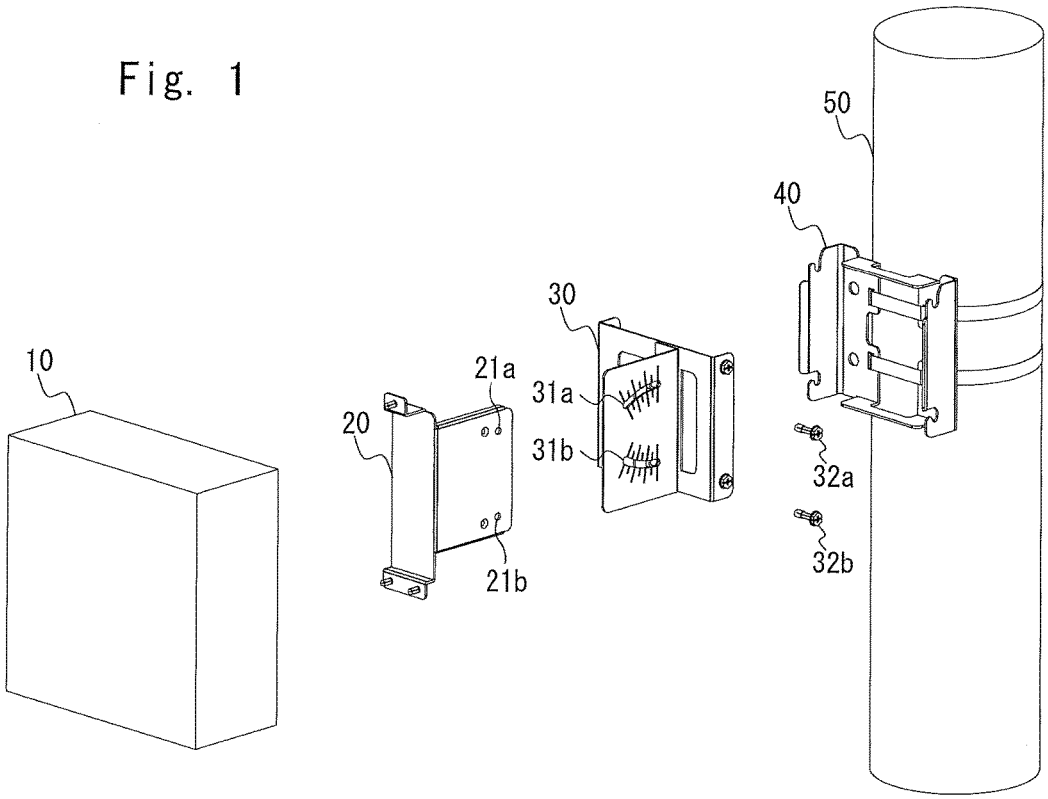
FIG. 1 is an exploded perspective view showing a configuration example of an attachment instrument for an electronic device according to a first embodiment.

FIG. 1 is an exploded perspective view showing a configuration example of an attachment instrument for an electronic device according to this embodiment. As shown in FIG. 1, the attachment instrument of this embodiment includes a device holding part 20 that holds an electronic device 10, an elevation angle adjustment part 30 (a first angle adjustment part) that is engaged with the device holding part 20 and adjusts an elevation angle of an antenna included in the electronic device 10, and a column attached part 40 that is engaged with the elevation angle adjustment part 30 and attached to a support column 50 such as a utility pole.

The electronic device 10 is a communication apparatus integrated with an antenna. The electronic device 10 is, for example, a point-to-point communication apparatus.

The device holding part 20 has a vertical surface on a side opposite to a surface for holding the electronic device 10. Round holes 21*a* and 21*b* (first round holes) are formed in the vertical surface. The round holes 21*a* and 21*b* are formed at positions corresponding to long holes 31*a* and 31*b* (first long holes), respectively, of the elevation angle adjustment part 30, which will be described later. Screws 32*a* and 32*b* serving as axes moving inside the long holes 31*a* and 31*b* are inserted into the round holes 21*a* and 21*b*, respectively. Note that a method for holding the electronic device 10 by the device holding part 20 is not an essential matter of the present disclosure, and an arbitrary method can be used.

The elevation angle adjustment part 30 includes a vertical surface (first plane) in which two arc-shaped long holes 31*a* and 31*b* (first long holes) are formed. The long hole 31*a* has an arc shape (a radius of the arc is equal to a distance between the round hole 21*a* and the round hole 21*b*) around one point (a predetermined position to be a rotation axis described later) inside the long hole 31*b*. The long hole 31*b* has an arc shape (a radius of the arc is equal to a distance between the round hole 21*a* and the round hole 21*b*) around one point (a predetermined position to be a rotation axis described later) inside the long hole 31*a*. In this embodiment, each of the predetermined position in the long hole 31*a* and the predetermined position in the long hole 31*b* is at one end on a back side of the arc when viewed from the electronic device 10. Further, the screw 32*a* is inserted into the long hole 31*a* as the axis moving inside the long hole 31*a*. The screw 32*a* is inserted into the round hole 21*a*. The screw 32*b* is inserted into the long hole 31*b* as the axis moving inside the long hole 31*b*. The screw 32*b* is inserted into the round hole 21*b*. Then, the device holding part 20 and the elevation angle adjustment part 30 are engaged. Note that it is assumed the screws 32*a* are 32*b* are screwed with nuts while they are inserted into the round holes 21*a* and 21*b*, respectively. It is further assumed that before the angle is adjusted, the screws 32*a* and 32*b* are movably inserted into the long holes 31*a* and 31*b*, respectively.

Screws protruding from the elevation angle adjustment part 30 are hooked onto cutout parts provided on both side surfaces of the column attached part 40. Then, the elevation angle adjustment part 30 is engaged with the column attached part 40. The method for engaging the elevation angle adjustment part 30 with the column attached part 40 is not an essential matter of the present disclosure. Thus, an arbitrary method other than the method shown in FIG. 1 can be used. Further, although the column attached part 40 is attached to the support column 50, this method of attachment is not an essential matter of the present disclosure, and an arbitrary method can be used.

Hereinafter, a method for adjusting the elevation angle of the antenna included in the electronic device 10 according to this embodiment will be described. In order to adjust the elevation angle of the antenna included in the electronic device 10, in the elevation angle adjustment part 30, the screw in one of the long holes 31*a* and 31*b* is fixed, and the screw in the other one of the long holes 31*a* and 31*b* is allowed to move. Then, the electronic device 10 is rotated in an elevation angle direction.

Figure 2:
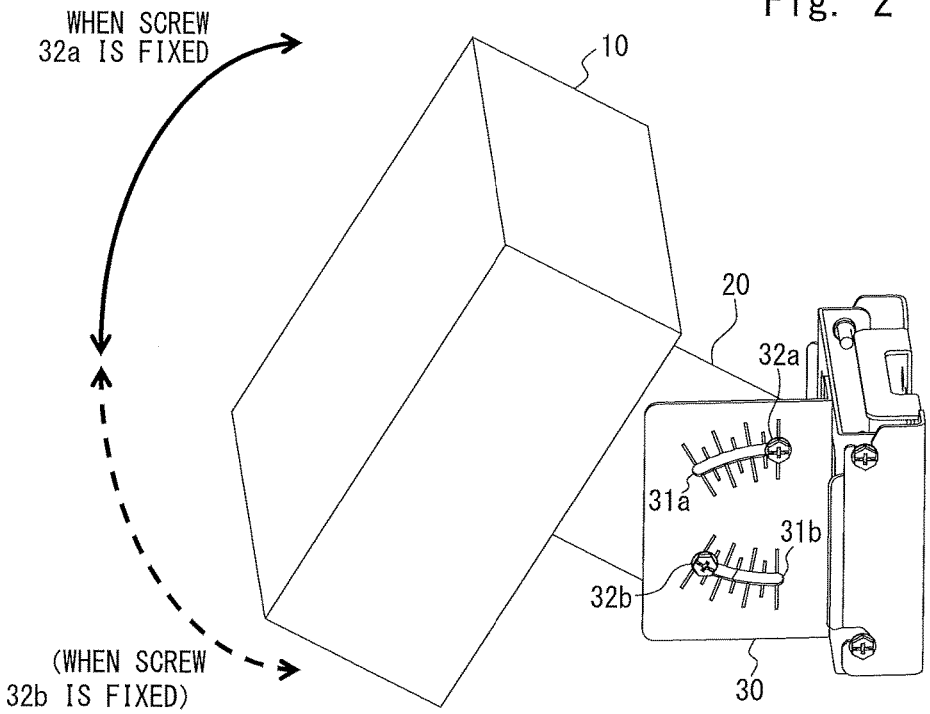
FIG. 2 is a perspective view showing an example of a state when the attachment instrument for the electronic device according to the first embodiment is used to adjust an elevation angle.

For example, as shown in FIG. 2, when the screw 32*a* in the long hole 31*a* is fixed, the screw 32*a* is fixed while being pressed at a predetermined position (one end on the back side of the arc when viewed from the electronic device 10) in the long hole 31*a*. In this state, only the screw 32*b* can be freely moved in the long hole 31*b*. Therefore, the electronic device 10 can be rotated in the elevation angle direction with the screw 32*a* positioned at the predetermined position in the long hole 31*a* as a rotation axis. The screw 32*b* in the long hole 31*b* functions as a rotation guide for guiding the rotation of the electronic device 10 in the elevation angle direction. In this manner, by rotating the electronic device 10 in the elevation angle direction, the elevation angle of the antenna included in the electronic device 10 is adjusted. Then, the screws 32*a* and 32*b* are tightened at positions where the elevation angle of the antenna included in the electronic device 10 reaches a desired angle. By doing so, the device holding part 20 is fixed to the elevation angle adjustment part 30.

On the other hand, when the screw 32*b* in the long hole 31*b* is fixed, the screw 32*a* in the long hole 31*a* is made to function as a rotation guide in the same manner as that described above.

As described above, in this embodiment, the two arc-shaped long holes are formed in the elevation angle adjustment part 30. In order to adjust the elevation angle of the antenna included in the electronic device 10, the screw in one of the two arc-shaped long holes is fixed, and the screw in the other long hole is allowed to move. Then, the electronic device 10 is rotated in the elevation angle direction.

Therefore, in this embodiment, the two rotation axes for rotating the electronic device 10 in the elevation angle direction are included. Therefore, as compared with a configuration having one rotation axis, an angle adjustment range of the elevation angle of the antenna included in the electronic device 10 is doubled even with the same size of the arc-shaped long holes (the length of the arc) as that of arc-shaped long hole in the configuration having one rotation axis. Accordingly, it is possible to enlarge the angle adjustment range of the antenna included in the electronic device 10 without increasing the size of the arc-shaped long holes, that is, without increasing the size of the attachment instrument.

Moreover, as the size of the attachment instrument can be made small, the size of the electronic device 10 protruding from the support column 50 can be reduced. Further, the attachment instrument can be made compact in size and light in weight. Additionally, the attachment instrument can also be achieved by a simple mechanism obtained by forming the two arc-shaped long holes. Furthermore, as compared to the mounting work for the configuration having one rotation axis, the mounting work for the configuration of this embodiment requires only the work of fixing the screw inserted into one of the two arc-shaped long holes. Thus, workability will not deteriorate with the configuration of this embodiment.

In this embodiment, the two arc-shaped long holes formed in the elevation angle adjustment part 30 are not limited to the shape and arrangement shown in FIG. 1. The two arc-shaped long holes need to satisfy only a condition that the shape thereof is an arc shape around one point (a predetermined position to be the rotation axis) in another long hole. However, from the viewpoint of enlarging the angle adjustment range, the predetermined positions in the two arc-shaped long holes are preferably at one ends of the arc, respectively.

Further, in this embodiment, the vertical surfaces included in the device holding part 20 and the elevation angle adjustment part 30 are arranged at substantially the center of the attachment instrument. However, the present disclosure is not limited to this. The vertical surfaces included in the device holding part 20 and the elevation angle adjustment part 30 may be arranged closer to the side surfaces or arranged on the side surfaces, respectively.

In this embodiment, a groove may be provided in each of the two arc-shaped long holes, and the screws may be fixed at the grooves to be used as the rotation axes. The grooves will be described in a third embodiment.

Furthermore, in this embodiment, the elevation angle of the antenna included in the electronic device 10 is adjusted. However, the present disclosure is not limited to this, and the attachment instrument may be configured to adjust an azimuth angle of the antenna included in the electronic device 10. In this case, the vertical surfaces of the device holding part 20 and the elevation angle adjustment part 30 may be horizontal surfaces, respectively. Moreover, in this embodiment, the electronic device 10 is held only by one vertical surface, but the present disclosure is not limited to this. Alternatively, both side surfaces may be the vertical surfaces to hold the electronic device 10. In addition, as described above, when the attachment instrument is configured to adjust the azimuth angle of the antenna included in the electronic device 10, it may be configured to hold the electronic device 10 only by one horizontal surface. Alternatively, the horizontal surfaces may be provided on both upper and lower surfaces to hold the electronic device 10. In this case, as the electronic device 10 is integrated with the antenna, a mass increases, and more force is required to adjust the orientation of or hold the electronic device 10 as compared with the case in which only the orientation of the antenna is to be adjusted and to be held. Therefore, when large force is required to adjust the orientation of and to hold the electronic device 10, it is preferable that the electronic device 10 be held by two surfaces. When the attachment instrument is configured to hold the electronic device 10 by both side surfaces or by both upper and lower surfaces, screws inserted into the two arc-shaped long holes in at least one surface may be tightened. That is, for example, on one side surface (or the lower surface), the screws inserted into the two arc-shaped long holes functioning as tightening members are tightened, while on the other side surface (or the upper surface), the screws inserted into the two-arc shaped long holes may be only inserted and not tightened.

(2) Second Embodiment

The above attachment instrument for the electronic device according to the first embodiment has the configuration capable of adjusting the elevation angle of the antenna included in the electronic device and holds the electronic device 10 only by one vertical surface.

On the other hand, an attachment instrument for an electronic device according to this embodiment can adjust both the elevation angle and the azimuth angle of the antenna included in the electronic device and holds the electronic device by two surfaces (both side surfaces or both upper and lower surfaces).

Figure 3:
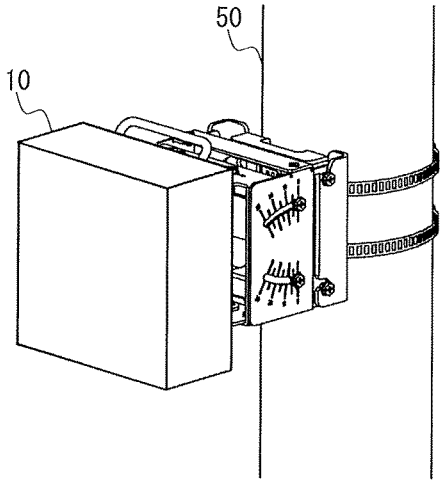
FIG. 3 is a perspective view showing an example of a state in which an electronic device is attached to a support column by an attachment instrument for an electronic device according to a second embodiment.
Figure 4:
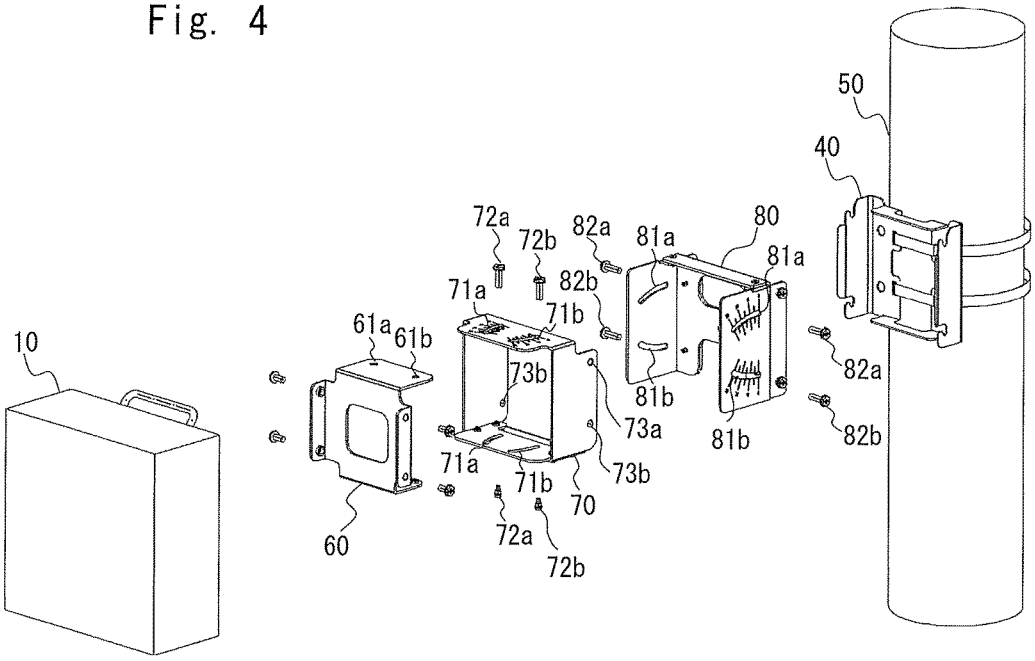
FIG. 4 is an exploded perspective view showing a configuration example of the attachment instrument for the electronic device according to the second embodiment.

FIGS. 3 and 4 show an example of the configuration of the attachment instrument for the electronic device according to this embodiment. FIG. 3 is a perspective view of a state in which the electronic device 10 is attached to the support column 50 by the attachment instrument according to this embodiment. FIG. 4 is an exploded perspective view showing a configuration example of the attachment instrument for the electronic device according to this embodiment. As shown in FIGS. 3 and 4, the attachment instrument of this embodiment includes a device holding part 60 that holds the electronic device 10, an azimuth angle adjustment part 70 (a first angle adjustment part) that is engaged with the device holding part 60 and adjusts an azimuth angle of an antenna included in the electronic device 10, an elevation angle adjustment part 80 (a second angle adjustment part) that is engaged with the azimuth angle adjustment part 70 and adjusts an elevation angle of the antenna included in the electronic device 10, and a column attached part 40 that is engaged with the elevation angle adjustment part 80 and attached to a support column 50 such as a utility pole.

In the device holding part 60, round holes 61*a* and 61*b* (first round holes) are formed in each of the upper and lower surfaces that are on the side opposite to the surfaces for holding the electronic device 10. The round holes 61*a* and 61*b* are formed at positions corresponding to long holes 71*a* and 71*b* (first long holes), respectively, of the azimuth angle adjustment part 70, which will be described later. Screws 72*a* and 72*b* serving as axes moving inside the long holes 71*a* and 71*b* are inserted into the round holes 61*a* and 61*b*, respectively. Note that a method for holding the electronic device 10 by the device holding part 60 is not an essential matter of the present disclosure, and an arbitrary method can be used.

In the azimuth angle adjustment part 70, the two arc-shaped long holes 71*a* and 71*b* (first long holes) are formed in each of the upper and lower surfaces (the first planes). The long hole 71*a* has an arc shape (a radius of the arc is equal to a distance between the round hole 61*a* and the round hole 61*b*) around one point (a predetermined position to be a rotation axis described later) inside the long hole 71*b*. The long hole 71*b* is has an arc shape (a radius of the arc is equal to a distance between the round hole 61*a* and the round hole 61*b*) around one point (a predetermined position to be a rotation axis described later) inside the long hole 71*a*. In this embodiment, each of the predetermined position in the long hole 71*a* and the predetermined position in the long hole 71*b* is at one end on a back side of the arc when viewed from the electronic device 10. Further, the screw 72*a* is inserted into the long hole 71*a* as the axis moving inside the long hole 71*a*. The screw 72*a* is inserted into the round hole 61*a*. The screw 72*b* is inserted into the long hole 71*b* as the axis moving inside the long hole 71*b*. The screw 72*b* is inserted into the round hole 61*b*. Then, the device holding part 60 and the azimuth angle adjustment part 70 are engaged. Note that it is assumed the screws 72*a* are 72*b* are screwed with nuts while they are inserted into the round holes 61*a* and 61*b*, respectively. It is further assumed that before the angle is adjusted, the screws 72*a* and 72*b* are movably inserted into the long holes 71*a* and 71*b*, respectively. Round holes 73*a* and 73*b* (second round holes) are formed in each of the side surfaces of the azimuth angle adjustment part 70. The round holes 73*a* and 73*b* are formed at positions corresponding to long holes 81*a* and 81*b* (second long holes), respectively, of the elevation angle adjustment part 80, which will be described later. Screws 82*a* and 82*b* serving as axes moving inside the long holes 81*a* and 81*b* are inserted into the round holes 73*a* and 73*b*, respectively.

The two arc-shaped long holes 81*a* and 81*b* (second long holes) are formed in each of side surfaces (second surfaces) of the elevation angle adjustment part 80. The long hole 81*a* is has an arc shape (a radius of the arc is equal to a distance between the round hole 73*a* and the round hole 73*b*) around one point (a predetermined position to be a rotation axis described later) inside the long hole 81*b*. The long hole 81*b* is has an arc shape (a radius of the arc is equal to a distance between the round hole 73*a* and the round hole 73*b*) around one point (a predetermined position to be a rotation axis described later) inside the long hole 81*a*. In this embodiment, each of the predetermined position in the long hole 81*a* and the predetermined position in the long hole 81*b* is at one end on a back side of the arc when viewed from the electronic device 10. Further, the screw 82*a* is inserted into the long hole 81*a* as the axis moving inside the long hole 81*a*. The screw 82*a* is inserted into the round hole 73*a*. The screw 82*b* is inserted into the long hole 81*b* as the axis moving inside the long hole 81*b*. The screw 82*b* is inserted into the round hole 73*b*. Then, the azimuth angle adjustment part 70 and the elevation angle adjustment part 80 are engaged. Note that it is assumed the screws 82*a* are 82*b* are screwed with nuts while they are inserted into the round holes 73*a* and 73*b*, respectively. It is further assumed that before the angle is adjusted, the screws 82*a* and 82*b* are movably inserted into the long holes 81*a* and 81*b*, respectively.

Screws protruding from the elevation angle adjustment part 80 are hooked onto cutout parts provided on both side surfaces of the column attached part 40. Then, the elevation angle adjustment part 80 is engaged with the column attached part 40. The method for engaging the elevation angle adjustment part 80 with the column attached part 40 is not an essential matter of the present disclosure. Thus, an arbitrary method other than the method shown in FIGS. 3 and 4 can be used. Further, although the column attached part 40 is attached to the support column 50, this method of attachment is not an essential matter of the present disclosure, and an arbitrary method can be used.

Hereinafter, a method for adjusting the elevation angle of the antenna included in the electronic device 10 according to this embodiment will be described. In order to adjust the elevation angle of the antenna included in the electronic device 10, in the elevation angle adjustment part 80, the screws in one of the long holes 81*a* and 81*b* are fixed, and the screws in the other one of the long holes 81*a* and 81*b* are allowed to move. Then, the electronic device 10 is rotated in an elevation angle direction.

Figure 5:
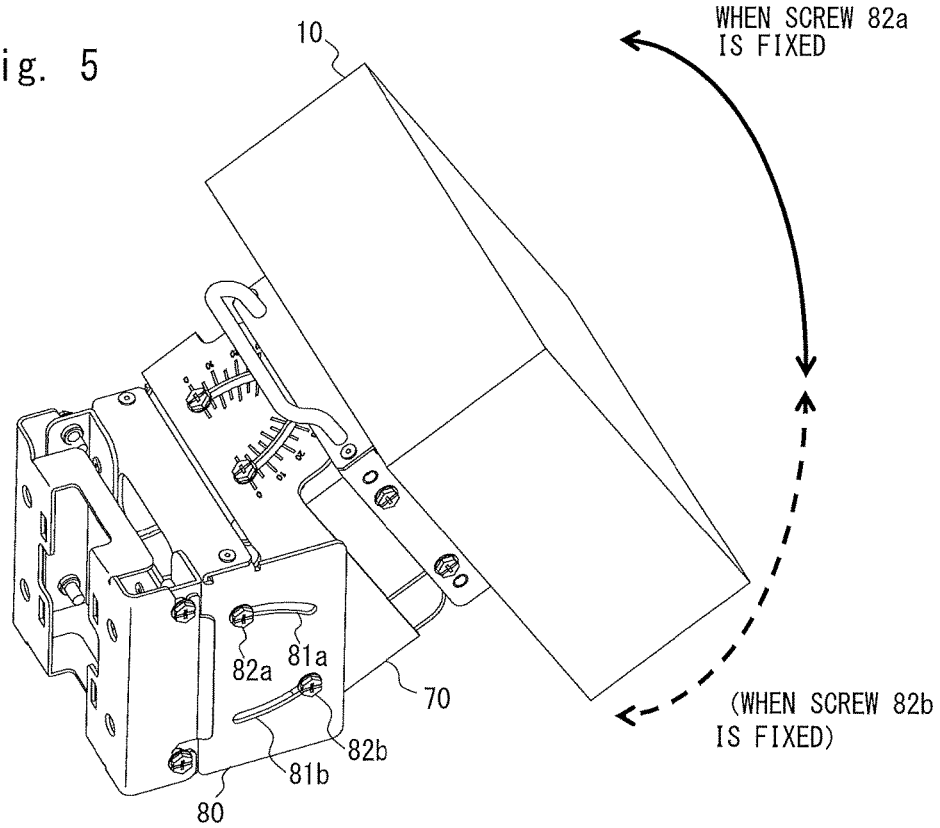
FIG. 5 is a perspective view showing an example of a state when the attachment instrument for the electronic device according to the second embodiment is used to adjust an elevation angle.

For example, as shown in FIG. 5, when the screws 82*a* in the long hole 81*a* are fixed, in the both side surfaces, the screws 82*a* are fixed while being pressed at predetermined positions (one end on the back side of the arc when viewed from the electronic device 10) in the long holes 81*a*. In this state, only the screws 82*b* can be freely moved in the long holes 81*b*. Therefore, the electronic device 10 can be rotated in the elevation angle direction with the screws 82*a* positioned at the predetermined positions in the long hole 81*a* as rotation axes in the both side surfaces. The screws 82*b* in the long holes 81*b* in the both side surfaces function as rotation guides for guiding the rotation of the electronic device 10 in the elevation angle direction. In this manner, by rotating the electronic device 10 in the elevation angle direction, the elevation angle of the antenna included in the electronic device 10 is adjusted. Then, in both of the side surfaces, the screws 82*a* and 82*b* are tightened at positions where the elevation angle of the antenna included in the electronic device 10 reaches a desired angle. By doing so, the azimuth angle adjustment part 70 is fixed to the elevation angle adjustment part 80.

On the other hand, when the screws 82*b* in the long holes 81*b* in the both side surfaces are fixed, the screws 82*a* in the long holes 81*a* in the both side surfaces the are made to function as rotation guides in the same manner as described above.

Next, a method for adjusting the azimuth angle of the antenna included in the electronic device 10 according to this embodiment will be described. In order to adjust the azimuth angle of the antenna included in the electronic device 10, in the azimuth angle adjustment part 70, the screws in one of the long holes 71*a* and 71*b* are fixed, and the screws in the other one of the long holes 71*a* and 71*b* are allowed to move. Then, the electronic device 10 is rotated in an azimuth angle direction.

Figure 6:
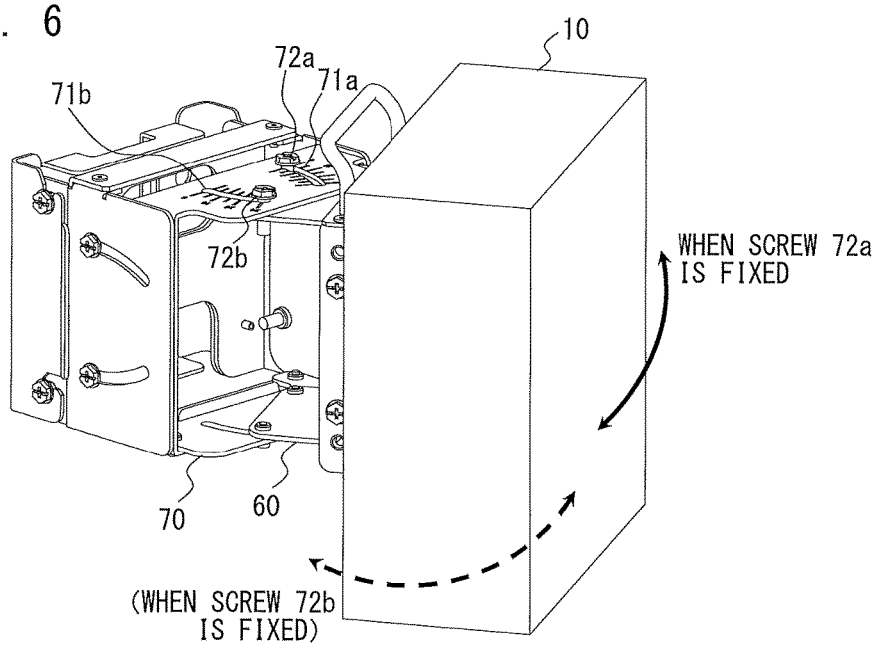
FIG. 6 is a perspective view showing an example of a state when the attachment instrument for the electronic device according to the second embodiment is used to adjust an azimuth angle.

For example, as shown in FIG. 6, when the screws 72*a* in the long holes 71*a* are fixed, in the both upper and lower surfaces, the screws 72*a* are fixed while being pressed at predetermined positions (one end on the back side of the arc when viewed from the electronic device 10) in the long holes 71*a*. In this state, only the screw 72*b* can be freely moved in the long hole 71*b*. Therefore, the electronic device 10 can be rotated in the azimuth angle direction with the screws 72*a* positioned at the predetermined positions in the long holes 71*a* as rotation axes in the both upper and lower surfaces. The screws 72*b* in the long holes 71*b* in the both upper and lower surfaces function as rotation guides for guiding the rotation of the electronic device 10 in the elevation angle direction. In this manner, by rotating the electronic device 10 in the azimuth angle direction, the azimuth angle of the antenna included in the electronic device 10 is adjusted. Then, in both upper and lower surfaces, the screws 72*a* and 72*b* are tightened at positions where the azimuth angle of the antenna included in the electronic device 10 reaches a desired angle. By doing so, the device holding part 60 is fixed to the azimuth angle adjustment part 70.

On the other hand, when the screws 72*b* in the long holes 71*b* in the both upper and lower surfaces are fixed, the screws 72*a* in the long holes 71*a* in the both upper and lower surfaces are made to function as rotation guides in the same manner as described above.

As described above, in this embodiment, the two arc-shaped long holes are formed in the both side surfaces of the elevation angle adjustment part 80. In order to adjust the elevation angle of the antenna included in the electronic device 10, the screws in one of the two arc-shaped long holes are fixed, and the screws in the other long holes are allowed to move. Then, the electronic device 10 is rotated in the elevation angle direction.

Further, the two arc-shaped long holes are formed in both of the upper and lower surfaces of the azimuth angle adjustment part 70. In order to adjust the azimuth angle of the antenna included in the electronic device 10, the screws in one of the two arc-shaped long holes are fixed, and the screws in the other long holes are allowed to move. Then, the electronic device 10 is rotated in the azimuth angle direction.

Therefore, in this embodiment, the two rotation axes for rotating the electronic device 10 in the elevation angle direction are included. Further, the two rotation axes for rotating the electronic device 10 in the azimuth angle direction are included. Therefore, as compared with a configuration having one rotation axis, an angle adjustment range of the azimuth angle of the antenna included in the electronic device 10 is doubled even with the same size of the arc-shaped long holes (the length of the arc) as that of arc-shaped long hole in the configuration having one rotation axis. Accordingly, it is possible to enlarge the angle adjustment range of the antenna included in the electronic device 10 without increasing the size of the arc-shaped long holes, that is, without increasing the size of the attachment instrument.

Moreover, as the size of the attachment instrument can be made small, the size of the electronic device 10 protruding from the support column 50 can be reduced. Further, the attachment instrument can be made compact in size and light in weight. Further, the attachment instrument can also be achieved by a simple mechanism obtained by forming the two arc-shaped long holes. Furthermore, in addition to the mounting work for the configuration having one rotation axis, the mounting work for the configuration of this embodiment further requires only the work of fixing the screws inserted into one of the two arc-shaped long holes. Thus, workability will not deteriorate with the configuration of this embodiment.

In this embodiment, the two arc-shaped long holes formed in the azimuth angle adjustment part 70 and the elevation angle adjustment part 80 are not limited to the shape and arrangement shown in FIGS. 3 and 4. The two arc-shaped long holes need to satisfy only a condition that the shape thereof is an arc shape around one point (a predetermined position to be the rotation axis) in the other long hole. However, from the viewpoint of enlarging the angle adjustment range, the predetermined positions in the two arc-shaped long holes are preferably at one ends of the arc, respectively.

Further, in this embodiment, the azimuth angle adjustment part 70 and the elevation angle adjustment part 80 are arranged in this order from the side of the electronic device 10. However, the present disclosure is not limited to this, and the order of the arrangement of the azimuth angle adjustment part 70 and the elevation angle adjustment part 80 may be reversed.

Furthermore, in this embodiment, in both side surfaces and in both upper and lower surfaces, the screws inserted in the two arc-shaped long holes are tightened, in other words, the screws are made to serve as the tightening members. However, the present disclosure is not limited to this, and the screws inserted into the two arc-shaped long holes may be tightened in at least one of the surfaces. That is, for example, on one side surface (or the lower surface), the screws inserted into the two arc-shaped long holes functioning as tightening members may be tightened, while on the other side surface (or the upper surface), the screws inserted into the two-arc shaped long holes may be only inserted and not tightened.

Moreover, in this embodiment, the electronic device 10 is held by two surfaces, i.e., both side surfaces and both upper and lower surfaces, but the present disclosure is not limited to this. For example, one horizontal surface in which two arc-shaped long holes are formed may be provided to the azimuth angle adjustment part 70, and one vertical surface in which two arc-shaped long holes are formed may be provided to the elevation angle adjustment part 80. Then, the electronic device 10 may be held by the one surface, i.e., the horizontal and vertical surfaces. In either case where the electronic device 10 is held by one surface or two surfaces, the plane of the azimuth angle adjustment part 70 and the plane of the elevation angle adjustment part 80 are orthogonal to each other.

(3) Third Embodiment

Compared with the above-described second embodiment, an attachment instrument for an electronic device of this embodiment further includes grooves for the two arc-shaped long holes formed in the azimuth angle adjustment part 70 and the elevation angle adjustment part 80. A configuration of the attachment instrument of this embodiment other than the grooves is the same as that of the attachment instrument of the second embodiment.

Figure 7:
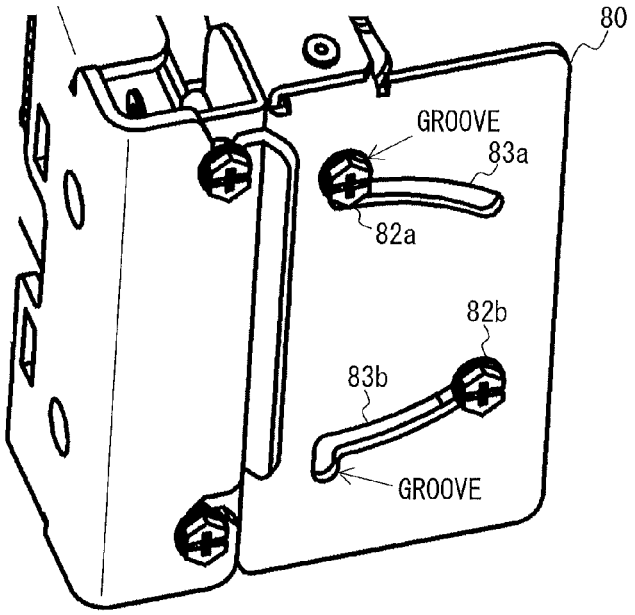
FIG. 7 is an enlarged perspective view showing a configuration example of a side part of an elevation angle adjustment part of an attachment instrument for an electronic device according to a third embodiment.

FIG. 7 is an enlarged perspective view showing a configuration example of a side part of the elevation angle adjustment part 80 of the attachment instrument for the electronic device according to this embodiment. As shown in FIG. 7, in the attachment instrument of this embodiment, the arc-shaped long holes 81*a* and 81*b* of the second embodiment are changed to two arc-shaped long holes 83*a* and 83*b* (second long holes) with grooves in the both side surfaces of the elevation angle adjustment part 80. The grooves of the long holes 83*a* and 83*b* are provided at one ends on the back side of the arc shapes when viewed from the electronic device 10 and on the outer arc side. The grooves of the long holes 83*a* and 83*b* will serve as rotation axes, which will be described later. The arc part of the long hole 83*a* is an arc shape around the groove of the long hole 83*b* (a radius of the arc is equal to a distance between the round hole 73*a* and the round hole 73*b*). The arc part of the long hole 83*b* is an arc shape around the groove of the long hole 83*a* (a radius of the arc is equal to a distance between the round hole 73*a* and the round hole 73*b*).

Figure 9:
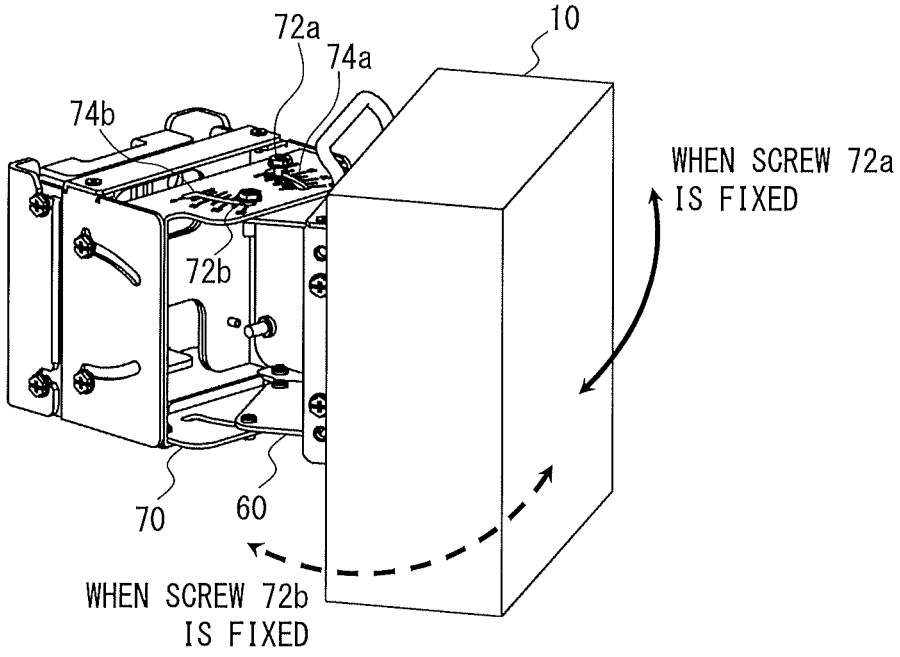
FIG. 9 is a perspective view showing an example of a state when the attachment instrument for the electronic device according to the third embodiment is used to adjust an azimuth angle.

As shown in FIG. 9, in the attachment instrument of this embodiment, the two arc-shaped long holes 71*a* and 71*b* of the second embodiments are changed to two arc-shaped long holes 74*a* and 74*b* (second long holes) with grooves in both upper and lower surfaces of the azimuth angle adjustment part 70. The grooves of the long holes 74*a* and 74*b* are provided at one ends on the back side of the arc shapes when viewed from the electronic device 10 and on the outer arc side. The grooves of the long holes 74*a* and 74*b* will serve as rotation axes, which will be described later. The arc part of the long hole 74*a* is an arc shape around the groove of the long hole 74*b* (a radius of the arc is equal to a distance between the round hole 61*a* and the round hole 61*b*). The arc part of the long hole 74*b* is an arc shape around the groove of the long hole 74*a* (a radius of the arc is equal to a distance between the round hole 61*a* and the round hole 61*b*).

Hereinafter, a method for adjusting the elevation angle of the antenna included in the electronic device 10 according to this embodiment will be described. In order to adjust the elevation angle of the antenna included in the electronic device 10, in the elevation angle adjustment part 80, the screws in one of the long holes 83*a* and 83*b* are fixed, and the screws in the other one of the long holes 83*a* and 83*b* are allowed to move. Then, the electronic device 10 is rotated in an elevation angle direction.

Figure 8:
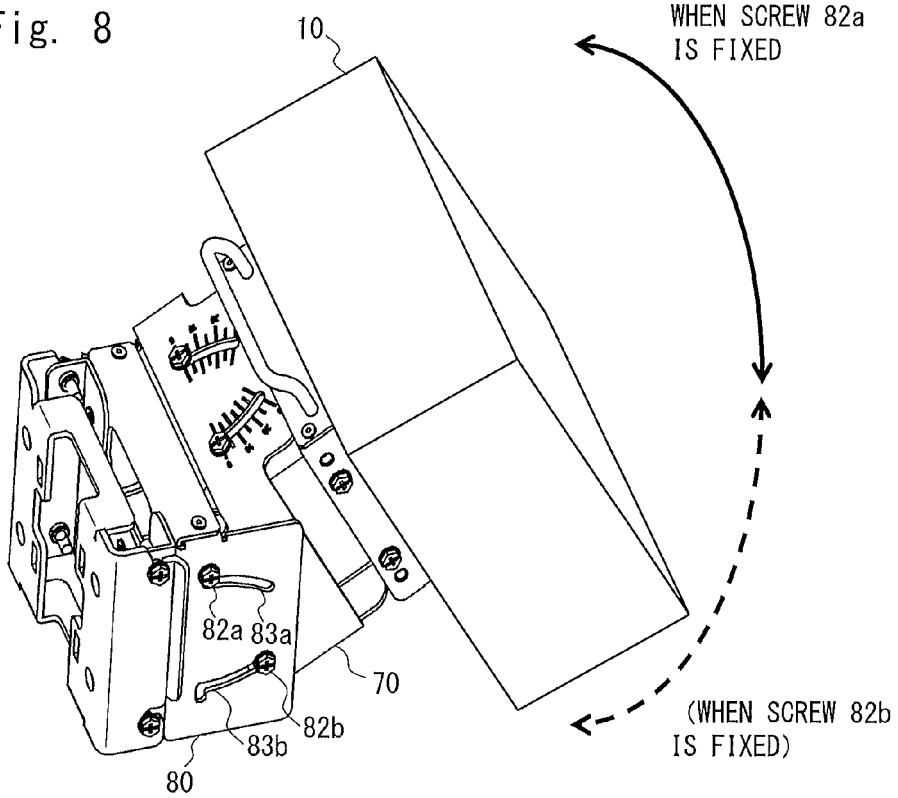
FIG. 8 is a perspective view showing an example of a state when the attachment instrument for the electronic device according to the third embodiment is used to adjust an elevation angle.

For example, as shown in FIG. 8, when the screws 82*a* in the long holes 83*a* are fixed, in the both side surfaces, the screws 82*a* are fixed while being pressed at the grooves of the long holes 83*a*. In this state, only the screws 82*b* can be freely moved in the arc parts of the long holes 83*b*. Therefore, the electronic device 10 can be rotated in the elevation angle direction with the screws 82*a* positioned at the grooves of the long holes 83*a* as rotation axes in the both side surfaces. The screws 82*b* in the long hole 83*b* function as rotation guides for guiding the rotation of the electronic device 10 in the elevation angle direction. In this manner, by rotating the electronic device 10 in the elevation angle direction, the elevation angle of the antenna included in the electronic device 10 is adjusted. Then, in the both side surfaces, the screws 82*a* and 82*b* are tightened at positions where the elevation angle of the antenna included in the electronic device 10 reaches a desired angle. By doing so, the azimuth angle adjustment part 70 is fixed to the elevation angle adjustment part 80.

On the other hand, when the screws 82*b* in the long holes 83*b* are fixed in both side surfaces, the screws 82*a* in the long holes 83*a* are made to function as rotation guides in the same manner as described above.

Hereinafter, a method for adjusting the azimuth angle of the antenna included in the electronic device 10 according to this embodiment will be described. In order to adjust the azimuth angle of the antenna included in the electronic device 10, in the azimuth angle adjustment part 70, the screws in one of the long holes 74*a* and 74*b* are fixed, and the screws in the other one of the long holes 74*a* and 74*b* are allowed to move. Then, the electronic device 10 is rotated in an azimuth angle direction.

For example, as shown in FIG. 9, when the screws 72*a* in the long holes 74*a* are fixed, the screws 72*a* are fixed while being pressed at the grooves of the long holes 74*a* in the both upper and lower surfaces. In this state, only the screws 72*b* can be freely moved in the arc parts of the long holes 74*b*. Therefore, the electronic device 10 can be rotated in the azimuth angle direction with the screws 72*a* positioned at the grooves of the long holes 74*a* as rotation axes in the both upper and lower surfaces. The screws 72*b* in the long holes 74*b* function as rotation guides for guiding the rotation of the electronic device 10 in the azimuth angle direction. In this manner, by rotating the electronic device 10 in the azimuth angle direction, the azimuth angle of the antenna included in the electronic device 10 is adjusted. Then, in the both upper and lower surfaces, the screws 72*a* and 72*b* are tightened at positions where the azimuth angle of the antenna included in the electronic device 10 reaches a desired angle. By doing so, the device holding part 60 is fixed to the azimuth angle adjustment part 70.

On the other hand, when the screws 72*b* in the long holes 74*b* are fixed in the both upper and lower surfaces, the screws 72*a* in the long holes 74*a* in the both upper and lower surfaces are made to function as rotation guides in the same manner as described above.

As described above, in this embodiment, the two arc-shaped long holes 83*a* and 83*b* with grooves are formed in the both side surfaces of the elevation angle adjustment part 80. When the screws in one of the long holes 83*a* and 83*b* are fixed at the grooves, and the screws in the other one of the long holes 83*a* and 83*b* are allowed to move, the electronic device 10 is rotated in the elevation angle direction.

Further, the two arc-shaped long holes 74*a* and 74*b* with grooves are formed in the both upper and lower surfaces of the azimuth angle adjustment part 70. When the screws in one of the long holes 74*a* and 74*b* are fixed at the grooves, and the screws in the other one of the long holes 74*a* and 74*b* are allowed to move, the electronic device 10 is rotated in the azimuth angle direction.

As described so far, since the positions where the screws are fixed are in the grooves, it is possible to intuitively know the positions where the screws are to be fixed, and thus it is easy to move the screw to the grooves. Additionally, the movement of the screws can be limited within the groove. Therefore, this embodiment achieves an effect of improving the mounting work as compared with the second embodiment. Other effects of the third embodiment are the same as those of the second embodiment.

Note that in this embodiment the positions of the grooves on the arcs in the two arc-shaped long holes formed in the azimuth angle adjustment part 70 and the elevation angle adjustment part 80 are described as one ends of the arcs. However, the present disclosure is not limited to this, and the grooves may be positioned at near the center of the arcs. However, from the viewpoint of enlarging the angle adjustment range, the positions of the grooves on the arcs are preferably at one ends of the arcs, respectively.

Furthermore, in this embodiment, although the positions of the grooves in the two arc-shaped long holes formed in the azimuth angle adjustment part 70 and the elevation angle adjustment part 80 are provided on the outer arc side, the present disclosure is limited to this. Alternatively, the grooves may be provided on the inner arc side. That is, for example, in the elevation angle adjustment part 80, the grooves may be provided on either the upper side or the lower side of the long holes. If both of the two grooves are arranged on the lower side of the long holes, it is possible to achieve an effect in which the orientation can be easily adjusted while the rotating axes are fixed with the weight of the electronic device 10.

Although the present disclosure has been described using the above-described embodiments as examples, the present disclosure is not limited to the above embodiments, and modifications can be made as appropriate without departing from the scope thereof. For example, in the second and third embodiments, the description of the method for adjusting the elevation angle of the antenna included in the electronic device 10 has been given first, and then the description of the method for adjusting the azimuth angle has been given. However, the order of adjusting the elevation angle and the azimuth angle is not limited to this.

Further, in the above-described embodiments, the communication apparatus integrated with an antenna is used as an example of the electronic device to be mounted. However, the present disclosure can be applied to a camera, a video camera, a display, or the like as the electronic device to be mounted.

Moreover, in the above-described embodiments, an example is described in which the electronic device and the attachment instrument are separately provided. However, the electronic device may be integrated with the attachment instrument. For example, the communication apparatus can be integrated with an antenna and an angle adjustment mechanism that corresponds to the attachment instrument of this embodiment.

The present application is based upon and claims the benefit of priority from Japanese Patent Application No. 2015-100152, filed on May 15, 2015, the entire contents of which are hereby incorporated by reference.

REFERENCE SIGNS LIST

10 ELECTRONIC DEVICE
20 DEVICE HOLDING PART
21*a*, 21*b* ROUND HOLE
30 ELEVATION ANGLE ADJUSTMENT PART
31*a*, 31*b* LONG HOLE
32*a*, 32*b* SCREW
40 COLUMN ATTACHED PART
50 SUPPORT COLUMN
60 DEVICE HOLDING PART
61*a*, 61*b* ROUND HOLE
70 AZIMUTH ANGLE ADJUSTMENT PART
71*a*, 71*b* LONG HOLE
72*a*, 72*b* SCREW
73*a*, 73*b* ROUND HOLE
74*a*, 74*b* LONG HOLE
80 ELEVATION ANGLE ADJUSTMENT PART
81*a*, 81*b* LONG HOLE
82*a*, 82*b* SCREW
83*a*, 83*b* LONG HOLE

The invention claimed is:

1. An attachment instrument for an electronic device comprising:

a first angle adjustment part configured to adjust an orientation of an antenna included in the electronic device by two arc-shaped first long holes formed in a first plane and two axes moving inside the two first long holes, respectively, wherein the first angle adjustment part makes the adjustment by the axis inside one of the first long holes being fixed and the axis inside the other one of the first long holes being allowed to move; and a second angle adjustment part configured to adjust an orientation of the antenna included in the electronic device by two arc-shaped second long holes formed in a second plane and two axes moving inside the two first long holes, respectively, the second plane being disposed orthogonal to the first plane, wherein the second angle adjustment part makes the adjustment by the axis inside one of the second long holes being fixed and the axis inside the other one of the second long holes being allowed to move.

2. The attachment instrument for the electronic device according to claim 1, further comprising a device holding part configured to hold the electronic device, wherein the two axes of the two first long holes are inserted into two first round holes in the device holding part, formed at positions corresponding to the two first long holes, respectively.

3. The attachment instrument for the electronic device according to claim 1, wherein the axis fixed inside the first long hole is fixed at a predetermined position in the first long hole.

4. The attachment instrument for the electronic device according to claim 3, wherein the predetermined position in the first long hole is at one end of the arc of the first long hole.

5. The attachment instrument for the electronic device according to claim 1, wherein a groove is provided for the first long hole, and the axis fixed inside the first long hole is fixed at the groove.

6. The attachment instrument for the electronic device according to claim 5, wherein the groove of the first long hole is provided at one end of the arc of the first long hole.

7. The attachment instrument for the electronic device according to claim 1, wherein the first angle adjustment part includes the first plane on both side surfaces or both upper and lower surfaces.

8. The attachment instrument for the electronic device according to claim 7, wherein the axes of the two first long holes serve as tightening members that are tightened and fixed in at least one of the first planes.

9. The attachment instrument for the electronic device according to claim 1, wherein the two axes of the two second long holes are inserted into two second round holes in the first angle adjustment part, formed at positions corresponding to the two second long holes, respectively.

10. The attachment instrument for the electronic device according to claim 1, wherein the axis fixed inside the second long hole is fixed at a predetermined position in the second long hole.

11. The attachment instrument for the electronic device according to claim 10, wherein the predetermined position in the second long hole is at one end of the arc of the second long hole.

12. The attachment instrument for the electronic device according to claim 1, wherein a groove is provided for the second long hole, and the axis fixed inside the second long hole is fixed at the groove.

13. The attachment instrument for the electronic device according to claim 12, wherein the groove of the second long hole is provided at one end of the arc of the second long hole.

14. The attachment instrument for the electronic device according to claim 1, wherein the second angle adjustment part includes the second plane on both upper and lower surfaces or both side surfaces.

15. The attachment instrument for the electronic device according to claim 14, wherein the axes of the two second long holes serve as tightening members that are tightened and fixed in at least one of the second planes.

16. An angle adjusting method for an electronic device comprising:

a first angle adjustment step for adjusting an orientation of an antenna included in the electronic device by two arc-shaped first long holes formed in a first plane and two axes moving inside the two first long holes, respectively, wherein in the first angle adjustment step, the adjustment is made by the axis inside one of the first long holes being fixed and the axis inside the other one of the first long holes being allowed to move; and a second angle adjustment step for adjusting an orientation of the antenna included in the electronic device by two arc-shaped second long holes formed in a second plane and two axes moving inside the two first long holes, respectively, the second plane being disposed orthogonal to the first plane, wherein the second angle adjustment part makes the adjustment by the axis inside one of the second long holes being fixed and the axis inside the other one of the second long holes being allowed to move.

17. A communication apparatus comprising:

an antenna;

a first angle adjustment mechanism configured to adjust an orientation of the antenna by two arc-shaped first long holes formed in a first plane and two axes moving inside the two first long holes, respectively, wherein the first angle adjustment mechanism makes the adjustment by the axis inside one of the first long holes being fixed and the axis inside the other one of the first long holes being allowed to move; and a second angle adjustment mechanism configured to adjust an orientation of the antenna included in the electronic device by two arc-shaped second long holes formed in a second plane and two axes moving inside the two first long holes, respectively, the second plane being disposed orthogonal to the first plane, wherein the second angle adjustment part makes the adjustment by the axis inside one of the second long holes being fixed and the axis inside the other one of the second long holes being allowed to move.

* * * * *